US007857181B2

(12) United States Patent
Sacks

(10) Patent No.: US 7,857,181 B2
(45) Date of Patent: Dec. 28, 2010

(54) MULTIPLE CONFIGURATION STRAP APPARATUS FOR BRIEFCASES AND OTHER CARRYING BAGS

(76) Inventor: Jerome Elliot Sacks, 8 Thoreau Rd., Lexington, MA (US) 02420

( * ) Notice: Subject to any disclaimer, the term of this patent is extended or adjusted under 35 U.S.C. 154(b) by 976 days.

(21) Appl. No.: 11/700,385

(22) Filed: Jan. 31, 2007

(65) Prior Publication Data

US 2007/0175940 A1 Aug. 2, 2007

Related U.S. Application Data

(60) Provisional application No. 60/763,998, filed on Feb. 1, 2006.

(51) Int. Cl.
*A45C 15/00* (2006.01)
*A45C 13/30* (2006.01)
*A45F 3/04* (2006.01)

(52) U.S. Cl. ..... 224/579; 224/578; 224/600; 224/627

(58) Field of Classification Search ..... 224/579, 224/578, 600, 627, 643, 153
See application file for complete search history.

(56) References Cited

U.S. PATENT DOCUMENTS 3,790,049 A * 2/1974 Bohanec ..... 294/139
5,415,332 A 5/1995 Kliot
5,431,317 A * 7/1995 Kliot ..... 224/153
5,577,652 A 11/1996 Cooper
5,881,932 A * 3/1999 Wadden ..... 224/153
5,927,581 A * 7/1999 Reddy et al. ..... 224/578
6,006,974 A * 12/1999 Varney et al. ..... 224/645
6,138,881 A * 10/2000 Paul et al. ..... 224/153
6,220,493 B1 4/2001 Iijima
6,311,884 B1 * 11/2001 Johnson ..... 224/627
6,460,746 B1 * 10/2002 Amram ..... 224/579
6,926,183 B2 * 8/2005 Chang ..... 224/260
7,160,028 B1 1/2007 Linday

OTHER PUBLICATIONS

ConvertaBrief ES briefcase/backpack system from CIL.com, search for convertabrief, Code 002-60169.

* cited by examiner

*Primary Examiner*—Nathan J Newhouse
*Assistant Examiner*—Lester L Vanterpool
(74) *Attorney, Agent, or Firm*—Jerome E Sacks

(57) ABSTRACT

This invention presents strap apparatus that is attached to a carrying bag such as a briefcase, computer bag, or golf club bag. In the first embodiment, the strap apparatus is constructed from a single strap that is configured as a closed loop. The closed loop is constrained to the sides of the bag near the top by two constraining means; the closed loop being divided into two strap segments of approximately equal lengths. Depending on how the straps are shouldered, the bag may be worn in a single-strap configuration, a backpack configuration, or a dual-strap configuration. Transitioning from one configuration to the other is easily done by the wearer without having to remove the apparatus from the bag. Furthermore when in the single-strap configuration, the straps stay together and appear to the casual observer as a single-strap as found on an ordinary bag. The appearance of the bag when in the single-strap configuration will not reveal its multimode capability.

5 Claims, 9 Drawing Sheets

FIG. 5b
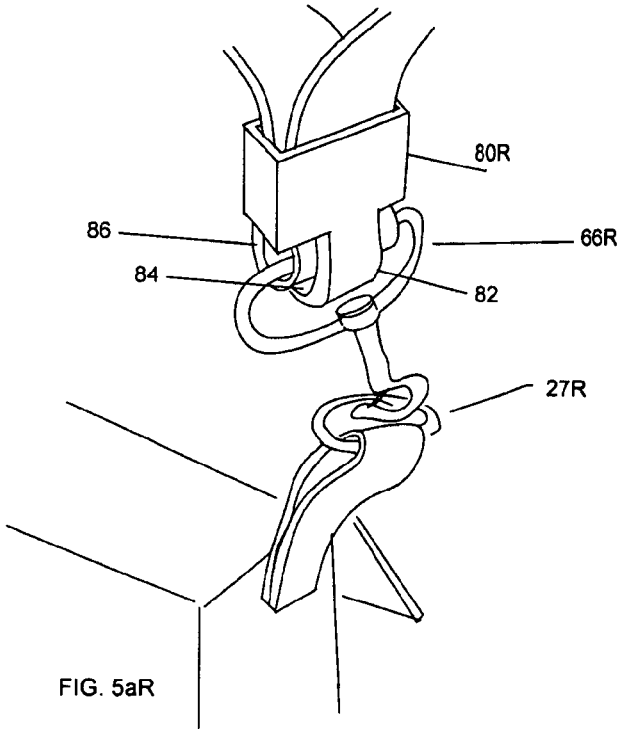
FIG. 5aR
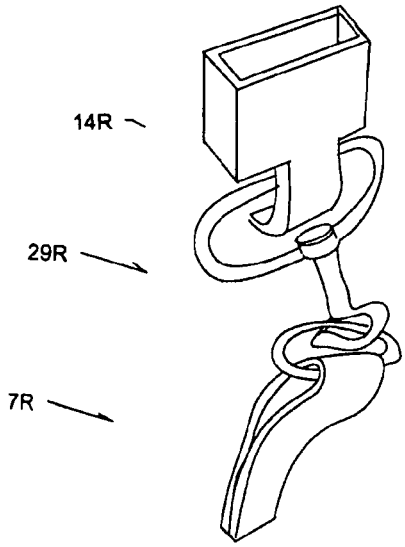
FIG. 5bR
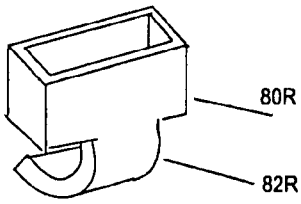
FIG. 5cR
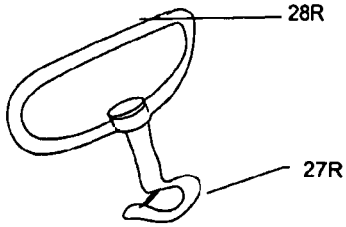
FIG. 5dR
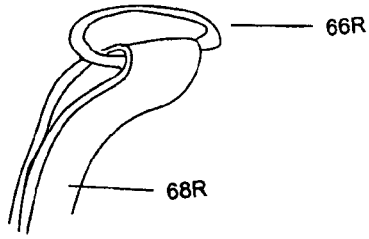
FIG. 5eR

MULTIPLE CONFIGURATION STRAP APPARATUS FOR BRIEFCASES AND OTHER CARRYING BAGS

CROSS-REFERENCES TO RELATED APPLICATIONS

This application claims the benefit of the provisional patent application Ser. No. 60/763,998 filed 2006 Feb. 1 by the present inventor.

FEDERALLY SPONSORED RESEARCH

None

SEQUENCE LISTING

None

BACKGROUND

This invention relates to carrying bags, specifically to carrying bags that have straps with a multimode capability.

There exists many strap apparatuses that convert single strap bags to backpacks, or have multimode capabilities. U.S. Pat. No. 6,311,884, B1, Dual Strap System for Conversion of Bags to Backpacks, presents an invention that has a backpack configuration that appears to be similar to the backpack configuration of my invention. A comparison between the two inventions however yields the other invention's deficiencies. It does not have a single-strap configuration; the user detaches the swivel snap hooks on the single strap that comes with the bag and then attaches the invention to the bag with its own swivel snap hooks. This is much less convenient than my invention.

U.S. Pat. No. 6,220,492, B1, Multi-Way Bag, has at least six different configurations, including a single-strap configuration and a backpack configuration. However to convert from one configuration to another, the strap needs to be detached from the bag and then reattached in a different way. Furthermore, the many guides, connectors and slits make the appearance of the bag less than desirable.

U.S. Pat. No. 5,881,932, Convertible Bag, has both a single-strap configuration and a backpack configuration. However the mechanisms for conversion are rather complex; furthermore if the bag is in a horizontal state when in the backpack configuration, then it must be rotated to a vertical state in the conversion to single-strap configuration. This is an undesirable feature for many types of bags. Finally, the bag itself has hidden compartments that hold the strap, so it is expensive to produce and does not apply to existing bag designs.

U.S. Pat. No. 5,415,332, Multimode Traveling Bag, has a single-strap configuration, a backpack configuration, and an over-the-head configuration. However it has an entirely different implementation than my invention. It uses a single length of strap, not doubled over to form a loop, rather than my invention, which uses a strap in the shape of a closed loop. Furthermore it does not apply to bags that open at the top, as many traveling bags do. My invention does.

U.S. Pat. No. 5,577,652, Convertible Backpack, is a bag with a single strap attached by swivel snap hooks. To convert from one configuration to another, either the hooks must be detached and then reattached in a different way; or the bag, if it hangs horizontally in the backpack configuration, will then hang vertically in the single-strap configuration.

U.S. Pat. No. 6,138,881, Convertible Backpack/Shoulder Bag, has a single strap with a zipper along the length of the strap. When the bag is worn as in the single-strap configuration, the zipper is closed presenting a single strap. To convert to the backpack configuration, the zipper is opened, revealing two straps. Although this is a fine approach to the multimode problem it appears only to apply to bags that are narrower at the top than at the bottom, limiting its use.

Eagle Creek used to sell Convertabrief, a briefcase-like bag with backpack straps hidden in a pocket. To convert from a single-strap configuration to the backpack configuration, the hidden straps would be removed from the hidden compartment and reattached using swivel snap hooks. They now sell a product, Convertabrief ES, which also has additional features like wheels and extendable handles. It is an attractive item for the traveler, but like most of the other inventions in the prior art it is difficult to reconfigure.

My invention has advantages that these other inventions do not have. Its design makes it easiest of all the inventions for the wearer to switch from one configuration to another. It may be incorporated into to most bags' existing design and does not detract from the appearance of the bag. It is also the only invention that has the dual-strap configuration. It is well suited for large bags like golf club bags, duffel bags, and musical instrument cases where the strap segments may be attached to the position on the bag between the top of the bag and the bottom of the bag.

SUMMARY

This invention provides a carrying bag with up to three configurations: a single-strap configuration, a backpack configuration and a dual-strap configuration. The richness of the embodiments and the simplicity for the user to switch from one configuration to the other makes it an attractive choice for any bag designer. It is the only invention that offers a dual-strap configuration where the bag is worn in like a single-strap bag; however the two straps emanate from the bag, one going over each shoulder, distributing the weight of the bag. Finally it is a novel design that will facilitate its marketing.

DRAWINGS

There are 9 sheets with 23 figures.

Figure 4A:
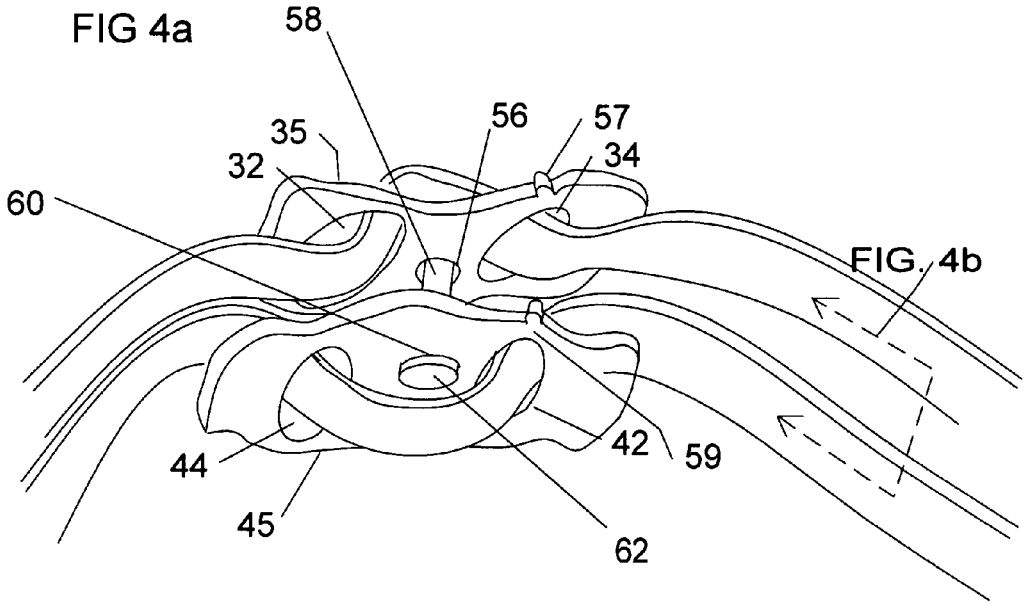

FIG. 4*a* shows the rotator member in the single-strap configuration with the straps passing through it.

Figure 4B:
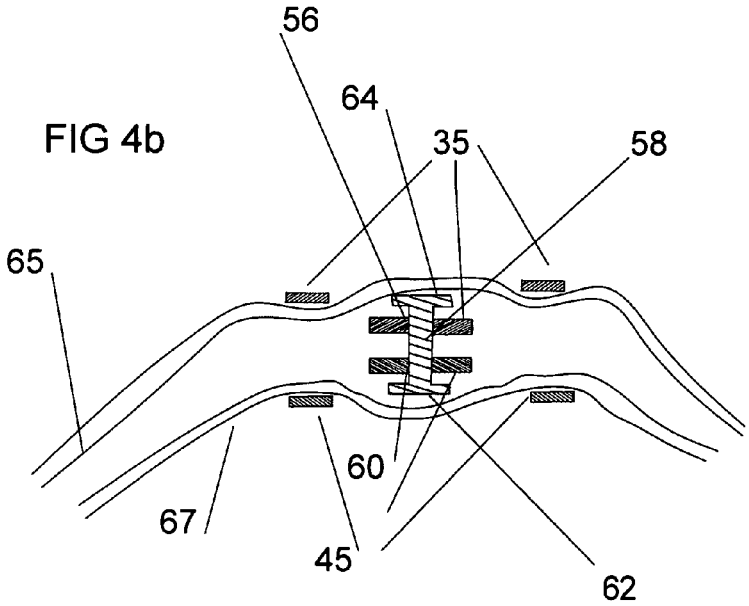

FIG. 4*b* shows the cross section of the rotator member.

Figures 5A, 5B, 5C, 5D, 5E:
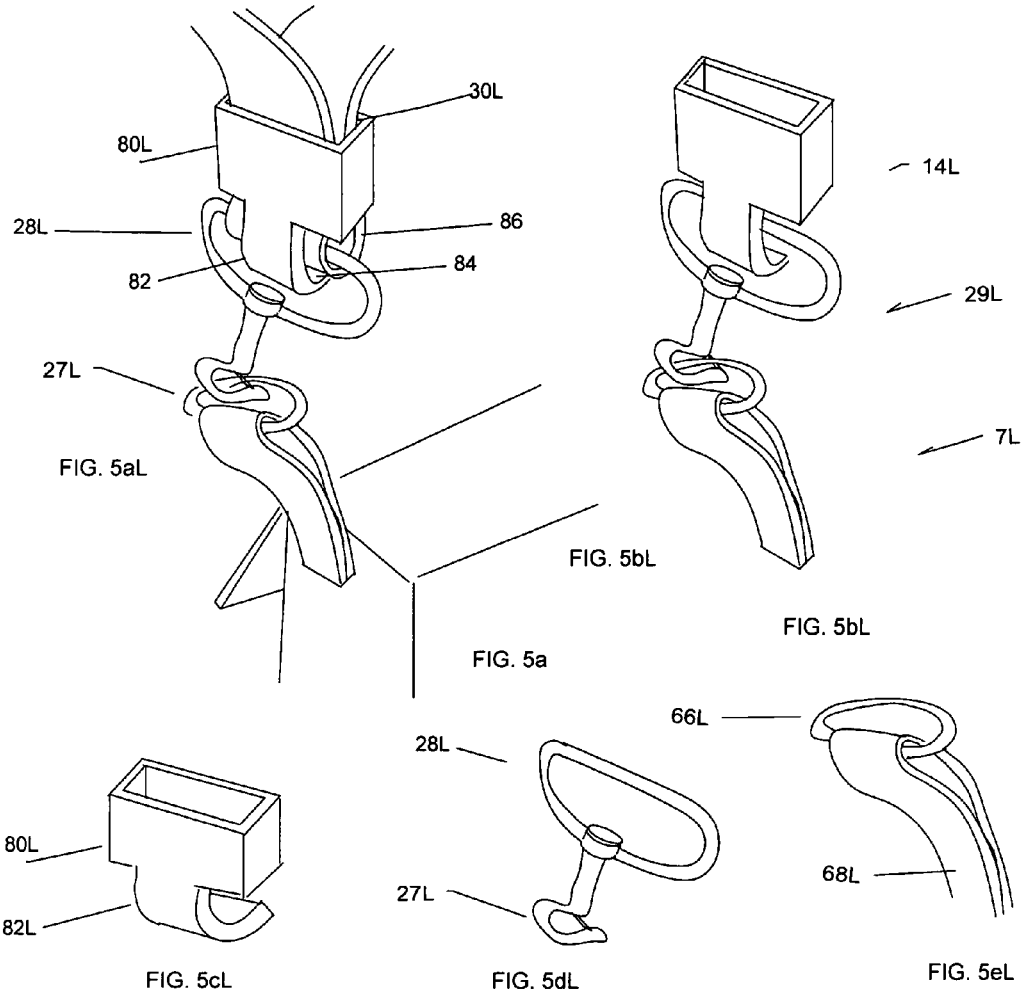

FIG. 5*a*L and 5*a*R shows the constraining member on the left and right side respectively with the strap passing through it.

FIG. 5*b*L and 5*b*R show the constraining member components for the left and right sides.

FIG. 5*c*L and 5*c*R show the slide member components for the left and right sides.

FIG. 5*d*L and 5*d*R show the swivel snap hook components for the left and right side.

FIG. 5*e*L and 5*e*R show the attachment members for the left and right sides.

Figure 6A:
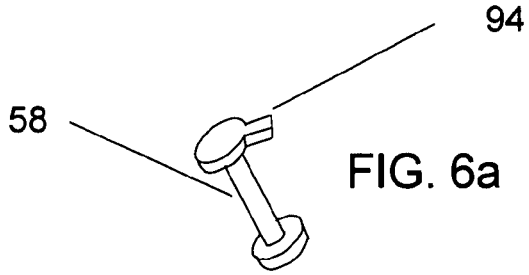

FIG. 6*a* shows the rivet of the rotator member (second embodiment).

Figure 6B:
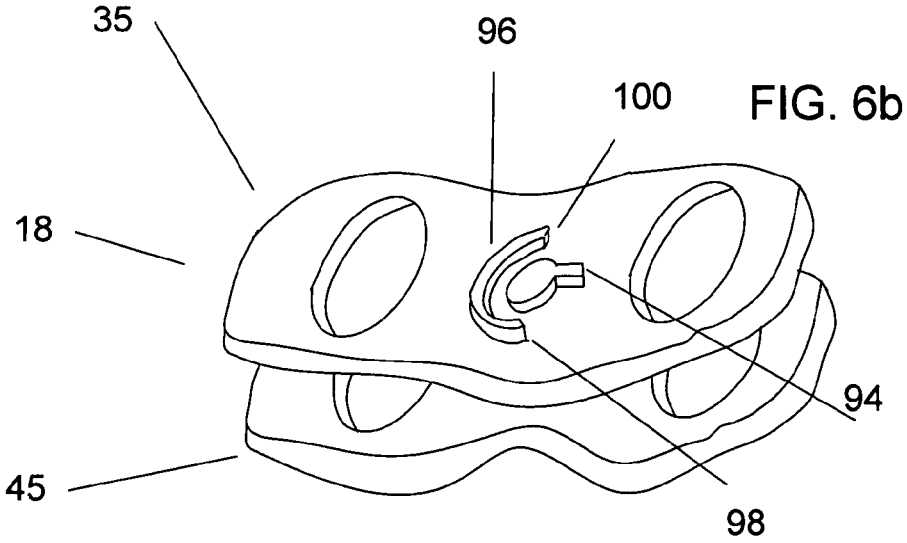

FIG. 6*b* shows a top view of the rotator member (second embodiment).

Figure 6C:
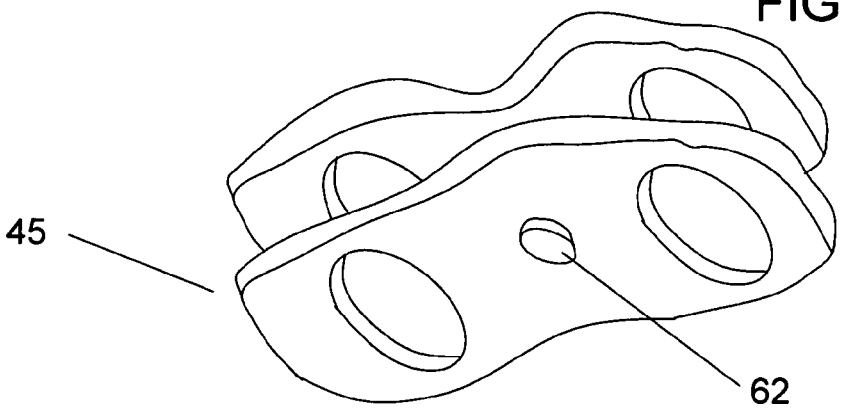

FIG. 6*c* shows a bottom view of the rotator member (second embodiment).

Figure 7A:
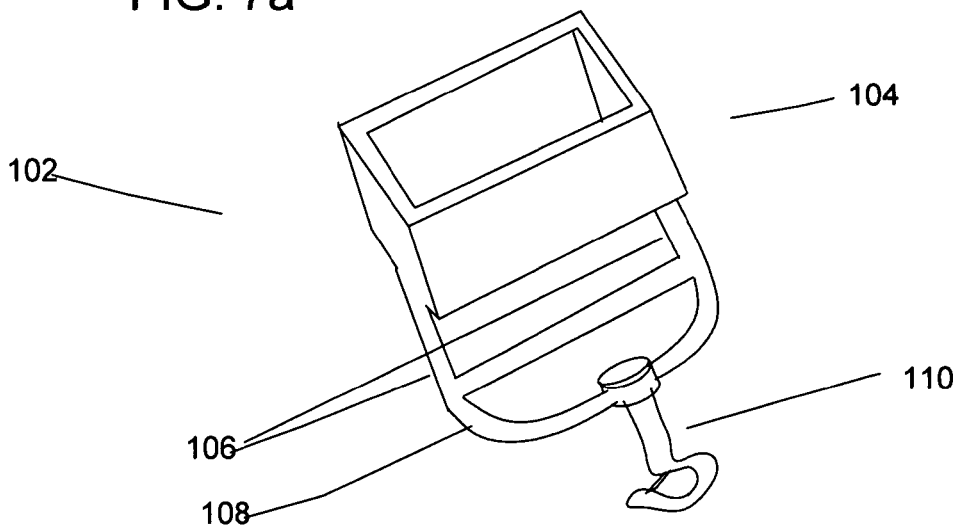

FIG. 7*a* shows a slide member (second embodiment).

Figure 7B:
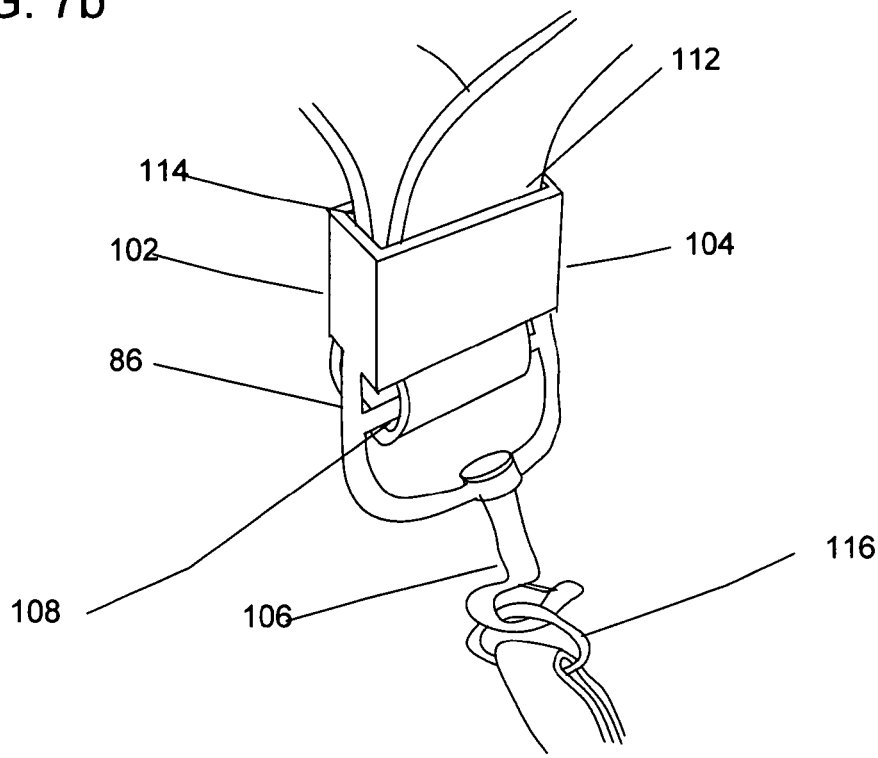

FIG. 7*b* show the slide member with strap going through (second embodiment).

Figure 8A:
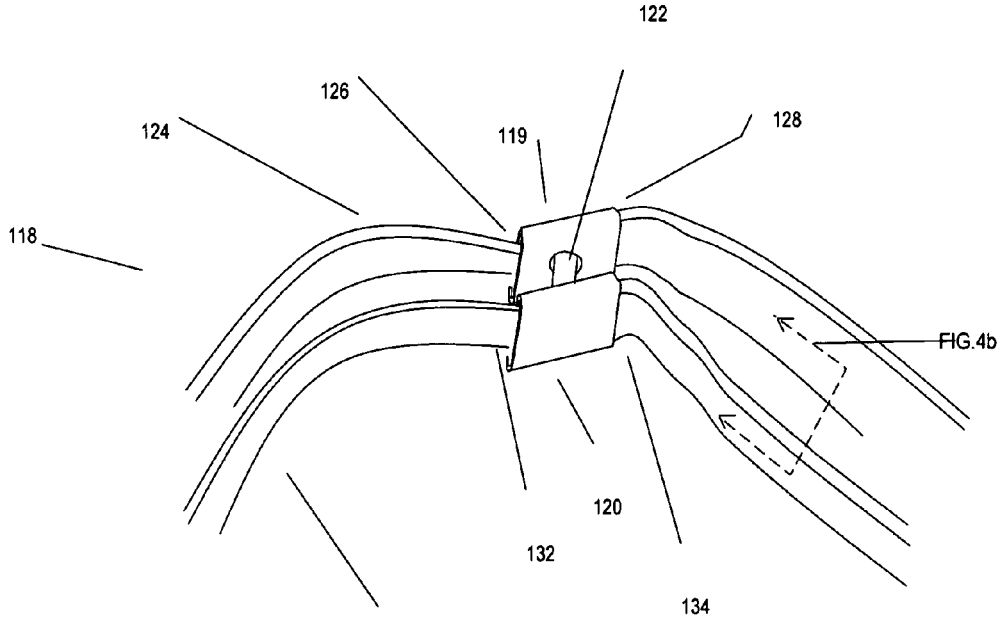

FIG. 8*a* shows the rotator member (third embodiment).

Figure 8B:
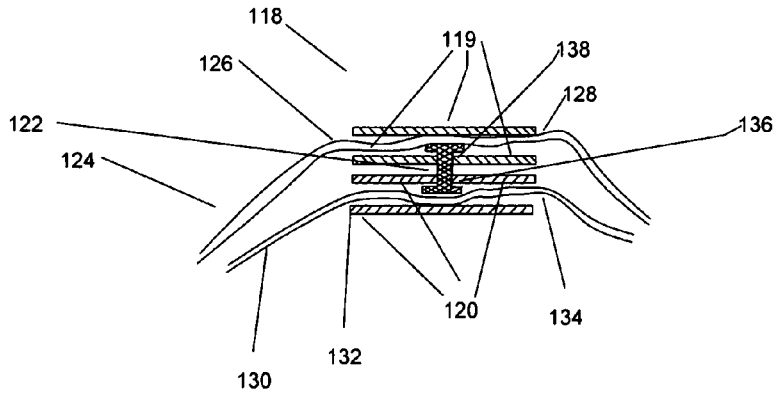

FIG. 8*b* shows a cross section of the rotator (third embodiment).

Figure 8C:
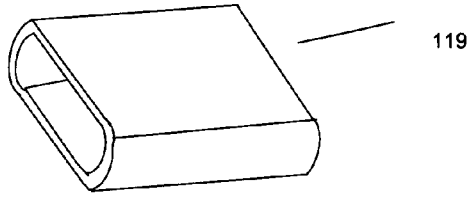

FIG. 8*c* shows the top component of the rotator member (third embodiment).

REFERENCE NUMERALS

3 Carrying Bag
3L Left side of bag
3R Right side of bag
3T Top of bag
3BT Bottom of bag
3F Front of bag
3B Back of bag
4 Strap
5R Constraining member on right side
5L Constraining member on left side
7R Right attachment member
7L Left attachment member
9O First strap segment
9I Second strap segment
10 Single loop
12 Double loop
14L Left Slide member
14R Right Slide member
18 Rotator member
19 Strap adjustment mechanism
27L Snap hook component of left swivel snap hook
27R Snap hook component of right swivel snap hook
28L Loop component of left swivel snap hook
28R Loop component of right swivel snap hook
29 Swivel snap hook
29L Left swivel snap hook
29R Right swivel snap hook
32 Rotator member top component first loop
34 Rotator member top component second loop
35 Rotator member top component
42 Rotator member bottom component first loop
44 Rotator member bottom component second loop
45 Rotator member bottom component
46 Single loop opening
48 Strap loop exit point
50 Strap second end
52 Strap second end attachment place
56 Rotator member top component hole
57 Rotator member top component protuberance
58 Rivet
59 Rotator member bottom component protuberance
60 Rotator member bottom component hole
62 Rivet bottom end
64 Rivet top end
65 Top strap section
66L Ring on left side
66R Ring on right side
67 Bottom strap section
68L Attachment component on left side
68R Attachment component on right side
80R Slide member slide component on right side
80L Slide member slide component on LEFT side
82L Slide member bracket component on left side
82R Slide member bracket component on right side
84 Slide member clearance
86 Strap section
94 Rivet top end extension
96 Rotator member top component ridge
98 Rotator member top component ridge first end
100 Rotator member top component ridge second end
102 Slide swivel snap hook member
104 Slide swivel snap hook member slide component
106 Slide swivel snap hook member side bars
108 Slide swivel snap hook member loop
110 Slide swivel snap hook snap hook component
112 Strap entry point
114 Strap exit point
118 Rotator member (third embodiment)
119 Rotator member top component (third embodiment)
120 Rotator member bottom component (third embodiment)
122 Rivet (third embodiment)
124 Top strap (third embodiment)
126 Top strap entry point (third embodiment)
128 Top strap exit point (third embodiment)
130 Bottom strap (third embodiment)
132 Bottom strap entry point (third embodiment)
134 Bottom strap exit point (third embodiment)
136 Bottom component hole (third embodiment)
138 Top component hole (third embodiment)

DESCRIPTION OF THE INVENTION

First Embodiment

The following description applies to the first embodiment of the invention.

Figure 1:
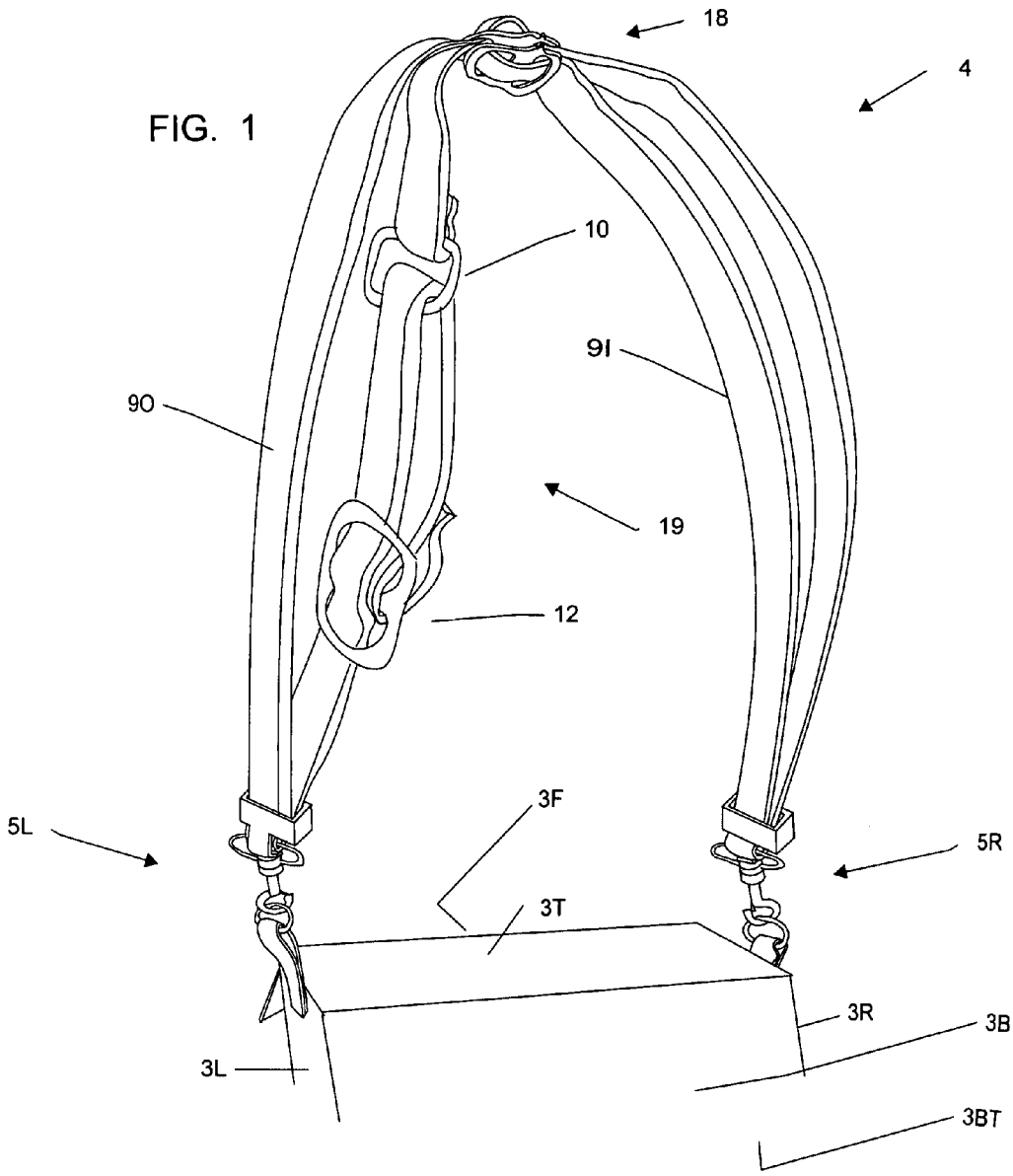
FIG. 1 shows my invention in the single-strap configuration.

FIG. 1 shows a perspective view of the first embodiment configured in the single-strap configuration. The bag 3 has a right side 3R, a left side 3L, a top 3T, and a bottom 3B. The first embodiment consists of the bag 3, a single length of strap 4, swivel snap hooks 29L and 29R, a strap adjustment mechanism 19, right side constraining member 5R, left side constraining member 5L, and a rotator member 18. The strap adjustment mechanism 19 is constructed from the single loop 10 and a double loop 12 in the conventional manner for straps. The strap is attached to the bag 3 on the left side 3L and the right side 3R.

The single strap 4 is divided into a first strap segment 90, which is on the outside and a second strap segment 91, which is on the inside in the single strap configuration. The two strap segments each extent form the first constraining member to the second constraining member. When the bag is in the single-strap configuration and worn over one shoulder, the two straps appear as a single strap to a casual observer.

Figure 2:
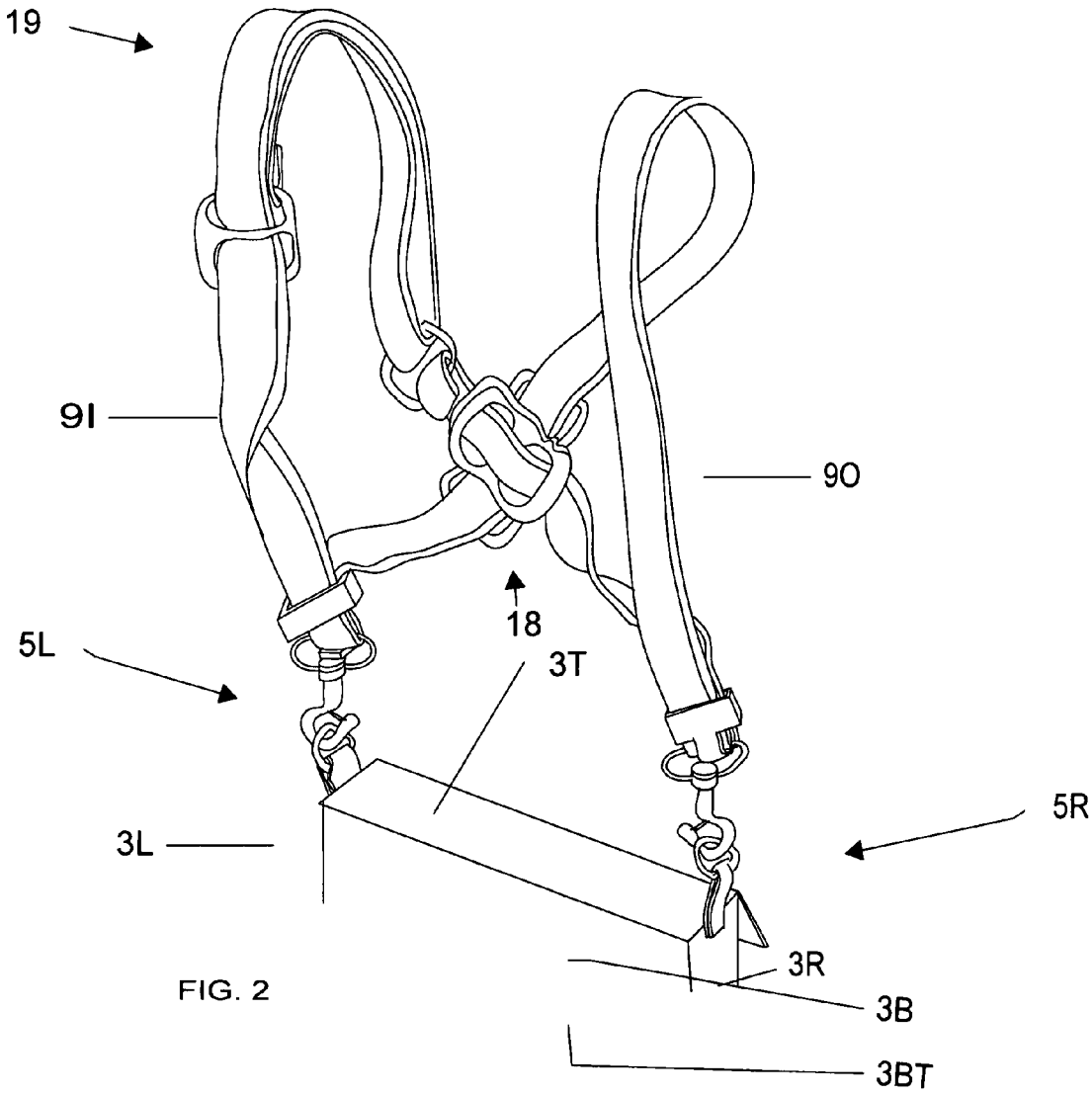
FIG. 2 shows the invention in the backpack configuration.

FIG. 2 shows the first embodiment in the backpack configuration. The rotator member 18 is shown in FIG. 4*a* and a cross section of the rotator member 18 is shown in FIG. 4*b*.

Figure 3:
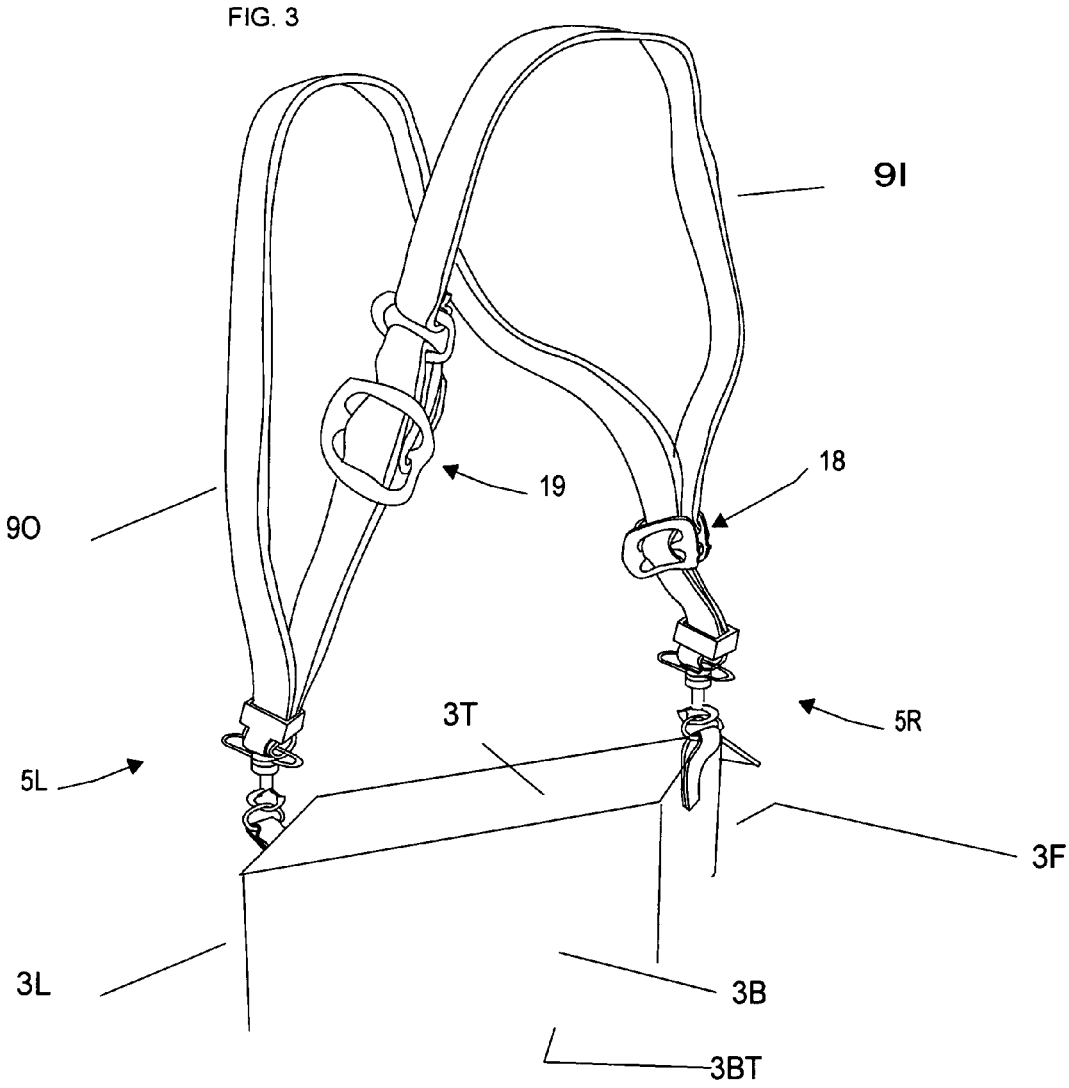
FIG. 3 shows the invention in the dual-strap configuration.

FIG. 3 shows the strap apparatus in the dual-strap configuration. In this configuration the rotator member 18 is disposed close to the right swivel snap hook 28R. The strap components are separated so that a strap segment can be put on each shoulder, with the bag hanging on a side of the wearer towards the back.

FIG. 4*a* shows the rotator member 18. It is composed of a top component 35, a bottom component 45 and a rivet 58. The top component 35 has two loops 32 and 34 to allow the strap to pass through. It has a hole 56 to allow the rivet to pass through. The bottom component 45 has two loops 42 and 44 to allow the strap to pass through. It has a hole 60 (hidden in FIG. 4*a*) to allow the rivet 58 to pass through. The rivet 58 passes through the hole 60 of the bottom component 45 and the hole 56 of the top component 35. It is capped on the rivet's bottom end 62 exiting from the bottom component 45 and on the top end 64 of the rivet exiting the top component 35. The three components of the swivel loop member 18 are manufactured so the top and bottom components rotate freely about the rivet after the straps are in place but will not separate. It is also manufactured so that the rotator member will not slide freely along the straps on its own by the force of gravity, but can be moved with minimal resistance by the wearer along the straps either to adjust the strap length, or to reconfigure the apparatus in the single-strap configuration, the backpack configuration or the dual-strap configuration.

A protuberance 57 occurs on the top component 35 of the rotator member 18 and a second protuberance 59 occurs on the bottom component 45 of the rotator member 18. They are positioned so that when the strap apparatus is configured in the single-strap configuration, one protuberance will lie directly above the other protuberance.

FIG. 4*b* shows a cross section of the rotator member with the straps in place. The rivet 58 passes through the top component 35 of the rotator member and the bottom component 45 of the rotator member through the holes 58 and 60. The top half strap 65 of the strap apparatus weaves through the top component 35 of the rotator member and the bottom half 67 of the strap apparatus weaves through the bottom component 45 of the rotator member.

FIG. 5*a*R shows the constraining member 5R for the right side with the strap constrained on the right side. FIG. 5*b*R shows the components of the constraining member 5R.

Referring to FIG. 5*b*R, the right side constraining member 5R consists of a right slide member 14R, a right swivel snap hook 29R, and a right attachment component 7R.

FIG. 5*c*R shows how the slide member 14R is designed. The slide member 14R consists of a slide component 80R and a bracket component 82R. In its manufacture, the slide component will allow the strap to slide through it with only slight resistance. It will also be snug enough to prevent the strap from twisting in the slide component 80R as it slides through the slide member 14R. The bracket component 82R is designed to keep the slide member positioned so the slide member 14R does not ride up the strap.

FIG. 5*d*R shows the structure of the right snap swivel hook 29R. The right swivel snap hook 29R is composed of a swivel loop 28R that accommodate the strap and can rotate freely, and the snap hook 27R which can be attached and removed from the attachment ring 66R.

FIG. 5*e*R shows the structure of the attachment member 7R. It is constructed with an attachment ring 66R and an attachment component 68R. The attachment component 68R is attached to the right side near the top, and the attachment ring 66R is attached to the attachment component 68R.

Referring to FIG. 5*a*R, the strap 4 enters through the slide component 80R of the slide member 14R, then through the loop 28R of the swivel snap hook 29R and then back through the slide component 80R of slide member 14R emerging from the slide component 80R. The bracket component 82R prevents the slide member 14R from riding up the strap away from the swivel snap hook. It has sufficient clearance between the strap 4 and the bracket component 82R so it will not hinder the strap as it slides through the slide component 80R when switching between the single-strap configuration and the backpack configuration and when adjusting the strap length.

FIGS. 5*a*L through 5*e*L show the details of the constraining member 5L for the left side with the strap constrained on the left side. The descriptions of these figures are entirely analogous to the right side FIGS. 5*a*R through 5*e*R and will not be repeated.

The strap apparatus can be attached and unattached to the bag using the two swivel snap hooks 29R and 29R and the attachment ring 66T and 66L. The left swivel snap hook 29L is attached to the bag by snapping the left swivel snap hook snap component 27L of the left swivel snap hook 29L onto the bag's left attachment ring 66L. The right swivel snap hook 29R is attached to the bag by snapping the right swivel snap hook snap component 27R of the right swivel snap hook 29R onto the bag's right attachment ring 66R.

Operation

To change the strap apparatus configuration from single-strap configuration of FIG. 1 to the backpack configuration of FIG. 2, do the following: Referring to FIG. 1, first hold the strap apparatus from the rotator member 18 positioned at the highest point of the two strap segments when the bag held with the bottom parallel to the floor, and let the bag hang so the strap is tight. The wearer arranges the strap if necessary so the strap sides aren't twisted. The wearer's left hand grabs the first strap segment 9O to the left of the top point with palm down. The wearer's right hand grabs the second strap segment 9I strap with the right hand palm down. Then the wearer lifts the bag holding the strap in the two places indicated. The wearer shakes the strap slightly if necessary. The weight of the bag will cause the strap to slide thorough the slide members 14L and 14R and the rotator member 18 until the backpack configuration of FIG. 2 is obtained. The wearer then puts the strap apparatus with the bag attached on in the standard way backpacks are put on the shoulders with the bag at the back of the wearer. FIG. 2 shows the strap in the backpack configuration.

To convert the strap apparatus from the backpack configuration to single-strap configuration, do the following. Referring to FIG. 2, take the backpack off the shoulders and hold in front of the wearer. Grab the rotator member 18 and rotate the top component so the protuberances are aligned. Then lift the rotator member 18 and shake gently until the single-strap configuration of FIG. 1 is obtained. It may be necessary to adjust the strap so the strap is not twisted.

To convert the strap apparatus from the single-strap configuration to the dual-strap configuration, the wearer does the following. Referring to FIG. 1, the wearer slides the rotator member 18 along the strap until it is adjacent to the right swivel snap hook 28R. The direction of the sliding should be away from the strap adjustment mechanism 19. Then the wearer puts the apparatus on so the bag is on one side towards the wearer's back; one strap is over the shoulder on the side of the bag, the other strap is over the other shoulder.

This completes the description of the first embodiment of this invention.

Second Embodiment

In the second embodiment of this invention the following two modifications are made.

For the first modification of this second embodiment, refer to FIG. 6*a*. The rivet 58 has an extension 94 on its top end. Referring to FIG. 6*b*, the top component 35 of the rotator member 18 has an added ridge 96. The bottom component 45 does not have a ridge. The ridge is attached permanently to the top component 35 so the rivet can rotate relative to the top component 35 between the ridge ends 98 and 100. It is constructed so that when the top member is situated in relation to the bottom member so the strap is in backpack configuration, the extension will may not rotate past the ridge end either at 98 or 100, depending which way the top component 35 is rotated relative to the bottom component 45. When the strap apparatus is in the single-strap configuration so the bottom component 45 and top component 35 are aligned as shown if the FIG. 6*b*, the extension 94 lies approximately half way between the ridge ends 98 and 100.

FIG. 6*c* shows a bottom view perspective of FIG. 6*b*. The rivet head 62 is attached permanently to the bottom component 45 of the rotator member 18. Note that the protuberances 57 and 59 of FIG. 4*a* are missing, since in this modification, the top component 35 and bottom component 45 can only be aligned in one way. With this modification, converting from backpack configuration to single-strap configuration is facilitated.

FIG. 7*a* shows the second modification to this second embodiment. The left slide member 14L and left swivel snap hook 28L shown in FIG. 1 are combined into a single swivel snap hook slide member 102 of FIG. 7*a*. The swivel snap hook slide member 102 consists of a slide component 104, two support components 106, a loop component 108 and a swivel snap hook 110. Similarly, the right slide member 14R and right swivel snap hook 28L are combined into a swivel snap hook slide member with the same design.

FIG. 7*b* shows how the strap loops through the slide swivel snap hook member 102. Compare to FIG. 5*b*. In FIG. 7*b*, the strap enters through the slide component 104 at entry point 112, then goes through the loop component 108 of the slide swivel snap hook member 102, and then back through the slide component 104 emerging 114. The swivel snap hook component swivels and is used to hook onto the bag loop 55R.

This completes the second embodiment of the invention.

Operation

The operation of the second embodiment follows that of the first embodiment.

Third Embodiment

FIG. 8*a* shows the third embodiment of this invention. The only manner in which this embodiment differs from the first embodiment is that the rotator member 118 has a different design from the rotator member 18 of the first embodiment. Referring to FIG. 8*a*, the rotator member 118 has a top component 119, a bottom component 120 and a rivet 122. The top component 119 has a flattened tube shape that will allow the top strap 124 to enter one end of the top component 126 and exit the other end 128. The bottom component has a flattened tube shape that will allow the bottom strap 130 to enter one end of the bottom component 132 and exit the other end 134. The top component 119 and the bottom component 120 are held together by a rivet 122 that allows the to components to rotate freely relative to each other.

FIG. 8*b* shows a cross section of the rotator member 118 of this embodiment. Referring to FIG. 8*b*, the top strap 124 enters 126 the top component 119 and exits 128 the top component 119 at the other end. The bottom strap 130 enters 132 the bottom component 120 and exits 134 the bottom component 130 at the other end. The rivet 122 attaches the two components together but allows them to rotate freely. The rivet passes through the bottom component through a hole 136 its top and through the top component through a hole 138 at its bottom.

FIG. 8*c* shows the top component 119 of the rotator member 118 in greater detail. The bottom component 120 is has the same design.

This completes the third embodiment of the invention.

Operation

The operation of the third embodiment follows that of the first embodiment.

CONCLUSIONS, RAMIFICATIONS AND SCOPE

These are not the only embodiments of my invention.

While my above description contains many specificities, these should not be construed as limitations on the scope of the invention, but rather as an exemplification of the presently preferred embodiments thereof. Many other ramifications and variations are possible within the teachings of the various embodiments.

For example,

Subsets of the three configurations may be implemented such as implementing only the single-strap and dual-strap configurations.

Shoulder pads may be added.

A rope-shaped strap, a chain or any other strap used for carrying bags, may be used as a strap, which is shown in these embodiments as a flat strap.

The components that attach the strap to the bag may be permanently attached to the bag; swivel snap hooks may be replaced by any other detachable connector.

Mechanisms may be added to the strap segments above the bag so the two strap segments stay together for a portion of the straps when in the single-strap configuration, but will release easily when transitioning it to the backpack or dual-strap configuration.

The fasteners are shown in the embodiments as rivets. Any attachment mechanism may be used such as but not limited to rivets, sewing, gluing, or fusion.

In any of the embodiments the strap adjustment mechanisms may be eliminated or included, and if included may have one or two.

Removable or permanent usage guides may be installed on the strap apparatus, temporarily or permanently, to assist the wearer in learning how place the hands when the wearer transitions the strap apparatus from the single-strap configuration to the backpack configuration.

Thus the scope of the invention should be determined by the appended claims and their legal equivalents, and not by the examples given.

I claim:

1. A multimode shoulder strap apparatus for a carrying bag, comprising:

(a) a carrying bag comprising a right side, a left side, a front, a back, a bottom, and a top, (a) a first strap segment and a second strap segment, the two strap segments having approximately equal lengths;

(b) said first strap segment and said second strap segment are comprised of a single strap, said strap having an approximate shape of a continuous closed loop;

(c) said strap is made out of a flat strap material;

(d) first constraining means for constraining one end of said first strap segment to said carrying bag disposed approximately at said right side and a second constraining means for constraining the other end of said first strap segment to said carrying bag disposed approximately at said left side; said first constraining means also constraining one end of said second strap segment to said carrying bag disposed approximately at said right side and said second constraining means also constraining the other end of said second strap segment to said carrying bag disposed approximately at said left side;

(e) said carrying bag having a single-strap configuration activated by a wearer by enacting the following sequentially: grabbing the two strap segments with one hand so said carrying bag hangs in a predominately upright position wherein said bottom of said carrying bag is parallel to the floor so that the two strap segments above said carrying bag appear similar to a single strap; putting the two strap segments over one shoulder so said carrying bag is worn as a single-strap shoulder carrying bag; and (f) said carrying bag having a backpack configuration activated by enacting the following sequentially: grabbing the two strap segments with the right hand so said carrying bag hangs in a predominately upright position; grabbing said first strap segment with left hand with palms down; grabbing said second strap segment with right hand with palms down; lifting said carrying bag by the two strap segments so said carrying bag hangs in a predominately upright position with said bottom of said carrying bag approximately parallel to the floor; putting the strap segments one on each shoulder so said carrying bag is on the users back and said carrying bag is worn as a backpack.

2. A multimode shoulder strap apparatus of claim 1 wherein (a) said first constraining means is comprised of a right slide member, a right swivel snap hook, and a right attachment member for constraining said strap approximately at said right side, and said left side constraining means is comprised of a left slide member, a left swivel snap hook, and a left attachment member for constraining said strap approximately at said left side;

(b) said right attachment member is attached to said right side near said top, said right attachment member having a right attachment ring so said strap passes through said right attachment ring slidably, and said left attachment component is attached to said left side near said top, said left attachment member having a left attachment ring so said strap passes through said left attachment ring slidably;

(c) said right swivel snap hook having a right loop at one end and a right snap hook at the other end, said right loop passing through said strap slidably on said right side, said right snap hook releasably attached to said right attachment ring, and said left swivel snap hook having a left loop at one end and a left snap hook at the other end, said left loop passing through said strap slidably on said left side, said left snap hook releasably attached to said left attachment ring;

(d) said right slide member is comprised of a right slide component and a right bracket component, said right slide component constraining said first strap segment and said second strap segment to stay contiguous on said right side, and said right bracket component constraining said right slide member to stay attached to said right swivel snap hook;

(e) and said left slide member is comprised of a left slide component and an a left bracket component on said left side, said left slide component constraining said first strap segment and said second strap segment to stay contiguous on said left side, and said left bracket component constraining said left slide member to stay attached to said left swivel snap hook, whereby when said carrying bag is in the single-strap configuration the two strap segments appear to a casual observer as a single strap.

3. A multimode shoulder strap apparatus of claim 1, wherein said carrying bag having a dual-strap configuration activated by the wearer by enacting the following in a sequential manner:

(a) wearer puts on said carrying bag in said single-strap configuration;

(b) wearer moves said first strap segment from the shoulder it is hanging on to the opposite shoulder so said carrying bag hangs with said first strap segment over one shoulder and said second strap segment over said other shoulder.

4. A multimode shoulder strap apparatus of claim 1 wherein said first strap segment and said second strap segment are slidably and releasably constrained by a rotator member, (a) said rotator member is comprised of a bottom member, a top member and a swivel component, (b) said bottom member slidably constraining said second strap segment, and said top member slidably constraining said first strap segment, and (c) said swivel component constraining said bottom member and said top member to be contiguous while allowing bottom member to rotate relative to said top member whereby said rotator member constrains said first strap segment and said second strap segment to stay contiguous so the two strap segments appear as a single strap when said carrying bag is in the single-strap configuration, and whereby said rotator member moves slidingly and rotatingly along the two strap segments when wearer puts the carrying bag in the backpack configuration so backpack so said rotator member is positioned where the two straps cross in the back.

5. A multimode shoulder strap apparatus of claim 1 wherein said first strap segment has a strap adjustment means for adjusting the strap segment lengths; whereby adjusting the lengths of the strap segments by the wearer is done when the carrying bag is in the single-strap configuration by enacting the following sequentially:

(a) changing length of said strap segments by adjusting said strap adjustment means to make said first strap segment to a different length, (b) grabbing the two strap segments with one hand so said carrying bag hangs in a substantially upright position with said bottom of said carrying bag parallel to the floor so the two strap segments above said carrying bag act like a single strap, (c) shaking said carrying bag until the straps segments adjusts so said first strap segment and said second strap segment having approximately the same lengths and said carrying bag hangs neatly appearing as a carrying bag with a single strap.

* * * * *